United States Patent [19]

Parker et al.

[11] Patent Number: 4,686,502

[45] Date of Patent: Aug. 11, 1987

[54] TERMINAL BRACKET STRUCTURE FOR A CURRENT LIMITING FUSE

[75] Inventors: Delbert R. Parker; Daren A. Clark, both of Centralia, Mo.

[73] Assignee: A. B. Chance Company, Centralia, Mo.

[21] Appl. No.: 879,969

[22] Filed: Jun. 30, 1986

[51] Int. Cl.[4] ..... H01H 85/02

[52] U.S. Cl. ..... 337/252; 337/158; 337/251

[58] Field of Search ..... 337/251, 252, 253, 254, 337/248, 158

[56] References Cited

U.S. PATENT DOCUMENTS

| | | | |
|---|---|---|---|
| 3,287,525 | 11/1966 | Mikulecky | 337/158 |
| 3,755,769 | 8/1973 | Mikulecky | 337/158 |
| 3,967,228 | 6/1976 | Koch et al. | 337/248 |
| 4,010,438 | 3/1977 | Scherer | 337/252 |
| 4,057,775 | 8/1977 | Biller | 337/186 |
| 4,146,862 | 3/1979 | Mikulecky | 337/252 |
| 4,506,249 | 3/1985 | Huber et al. | 337/158 |

*Primary Examiner*—Harold Broome

*Attorney, Agent, or Firm*—Schmidt, Johnson, Hovey & Williams

[57] ABSTRACT

A current limiting fuse has an electrical subassembly which includes fusible elements that are helically wound about a plurality of support plates which, in turn, are secured on each end to a terminal bracket. A leg member electrically and mechanically interconnects the terminal bracket to an end cap assembly fixed to a fuse housing and is flexible for allowing variation in distance between the end cap assembly and the internal subassembly such as would occur when the fuse is exposed to thermal excursions. The flexible leg has a portion which extends in generally transverse relation to the longitudinal axis of the subassembly, and the leg portion is swingable in an arc as the associated end cap assembly shifts relative to the position of the terminal bracket. A series of apertures on each terminal bracket receives end segments of the fusible element supporting plates, and the bracket includes pointed projections which are bendable toward a position of clamping engagement with the end segment of each plate to substantially preclude subsequent disengagement of the plate from the bracket. The electrical subassembly is rigid in nature by means of a unique arrangement of interlocking components even though the support plates are elongated in nature and comprised of a flexible material including mica particles.

9 Claims, 3 Drawing Figures

TERMINAL BRACKET STRUCTURE FOR A CURRENT LIMITING FUSE

BACKGROUND OF THE INVENTION

1. Field of the Invention

This invention relates to a fusible element support assembly for a current limiting fuse wherein a terminal bracket rigidly interconnects a plurality of mica plates in spaced disposition from each other and provides an electrical terminal between the fusible elements and end cap assemblies mounted on each end of a fuse housing. The terminal bracket has flexible structure for permitting the length of the housing to vary due to thermal expansion and contraction while maintaining an electrical and mechanical bond between the end cap assemblies and the fusible elements.

2. Description of the Prior Art

Current limiting fuses are well known in the art and typically comprise an elongated, tubular housing of electrically insulative material, a pair of electrically conductive end caps or terminals that are secured in covering relation to each end of the housing, as well as one or more fusible elements that are disposed within the housing and are electrically coupled to both of the end caps. In order to reduce the overall length of high voltage fuses, it is common practice to form the fusible element or elements to a helical configuration that extends longitudinally within the housing. As such, it is normally necessary to provide a support assembly within the housing that carries the fusible elements in such a fashion that adjacent turns of the element are maintained in spaced relationship to each other and are also retained in a predetermined distance from the interior walls of the housing.

One of the problems associated with support assemblies for high voltage current limiting fuses stems from the fact that electrically insulative support plates used for carrying the fusible elements are typically comprised of mica or mica particles which cause each individual support plate to be somewhat weak and yet quite flexible, and thus be readily susceptible to damage from mechanical stresses during assembly. Micaceous plates also have a relatively low hardness and consequently attempts to mechanically secure the plates to other structure have experienced limited success.

One type of support assembly for a current limiting fuse is shown in U.S. Pat. No. 4,057,775, dated Nov. 8, 1977 and includes two support plates of thin, sheet-like material each having a slot formed along the central axis and extending from one end of each plate to the middle thereof. The plates of the support structure shown in U.S. Pat. No. 4,057,775 are joined in perpendicular orientation so that the structure of both plates which defines respective slots engages each other. Two terminal brackets each have an aperture of an hourglass shape which recieves a narrowed end of the plate, and each bracket provides an electrical connection between a fusible element carried by the support assembly and end cap terminals mounted on the outside of a fuse housing. However, the strength of assembled the support structure shown in U.S. Pat. No. 4,057,775 is somewhat limited and careful handling is necessary during assembly.

Another problem associated with current limiting fuses is the thermal expansion and contraction that can occur when the fuse housing is subjected to temperature excursions, since the overall thermal co-efficient of expansion of the support assembly is often significantly different from the thermal co-efficient of expansion of the fuse housing. When the fuse is exposed to temperature fluctuations, any variation of the distance between the cap assemblies which are securely affixed to opposite ends of the fuse housing can subject the electrical path between the cap assemblies and the fusible elements to severe mechanical stress, often to the point of failure. U.S. Pat. No. 4,146,862, dated Mar. 27, 1979, illustrates an oil-immersible fuse wherein terminal brackets of an internal support assembly are electrically connected to an end cap by two tabs; however, it is believed that the provision of the two tabs shown in this reference does not satisfactorily accomodate stresses imposed on the internal components of the fuse when the latter is exposed to variations in temperature.

It would be a desirable advance in the art if a support assembly for fusible elements of a current limiting fuse was provided which presented a rigid structure when the component parts were assembled even though certain of the parts comprised relatively flexible and weak plates of micaceous material. Such a support assembly would desirably retain the electrical connection between the fusible element and end cap terminals mounted on a fuse housing even though the housing undergoes expansion and contracting during thermal cycling.

SUMMARY OF THE INVENTION

The present invention overcomes the above-noted disadvantages of prior art current limiting fuses by provision of a pair of novel, electrically conductive terminal brackets which each have structure defining a number of apertures for receiving and segments of mica support plates. The structure defining each of the apertures includes two opposed rows of triangular projections that are bendable toward a position of clamping engagement with the mica plate end segment for retaining the terminal bracket in fixed disposition relative to the mica plate. Preferably, three spaced support bodies or disks, also comprised of a micaceous material, are disposed between the terminal brackets and have walls defining a plurality of slots for transversely receiving the support plates, to thereby strengthen the assembly even though each individual plate is relatively flexible before the plates are interconnected by the terminal brackets.

The terminal brackets each have a single flexible leg connected to end cap assemblies on opposite ends of a fuse housing, and the leg is configured to permit variation in the distance between the end cap assemblies due to thermal expansion or contraction of the fuse housing while maintaining a mechanical and electrical connection between the end cap assemblies and the fusible elements carried on the support assembly. The leg preferably includes a portion which extends in a direction generally transverse to the longitudinal axis of the fuse, so that the leg is swingable in an arc to permit shifting of the end cap assemblies relative to the internal support assembly.

DETAILED DESCRIPTION OF THE DRAWINGS

Figure 1:
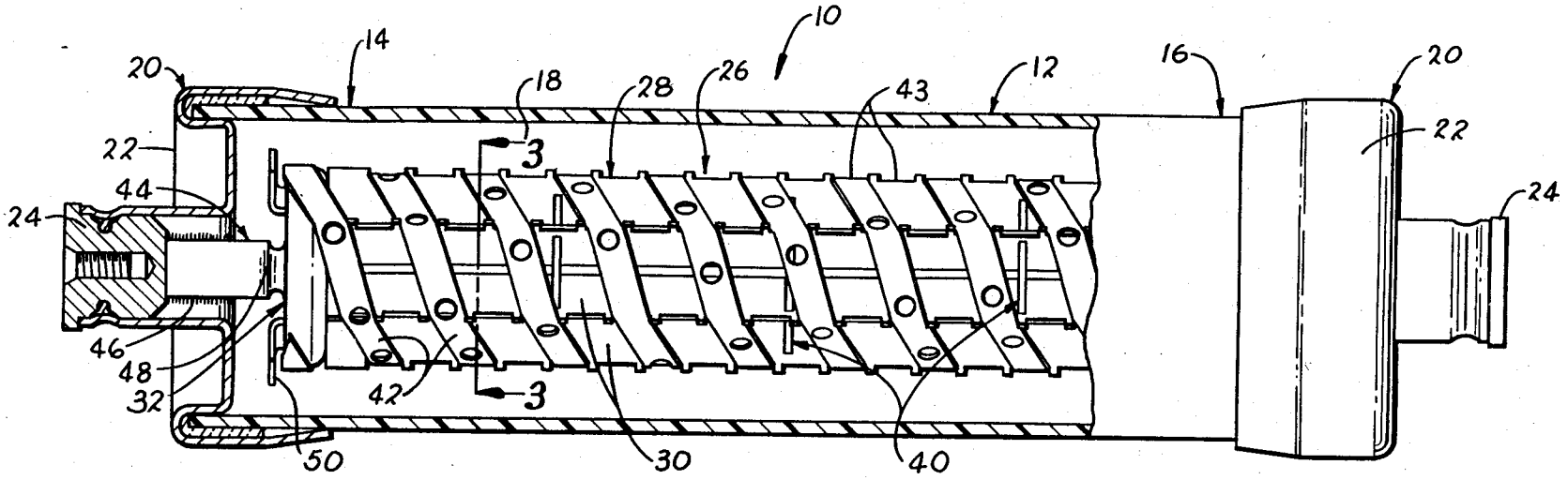
FIG. 1 is a side elevational view of the current limiting fuse of the present invention, with parts of the fuse broken away in section to reveal a pair of fusible elements and a support assembly for the elements disposed within a fuse housing.

Referring initially to FIG. 1, a high voltage current limiting fuse 10 of the present invention for voltages ranging from, for example, 8 to 23 kilovolts is illustrated and includes an elongated, cylindrical housing 12 comprised of an electrically insulated material and having a first end portion 14 and a second end portion 16 remote from the first end portion 14. The housing 12 has walls defining an elongated, cylindrical chamber 18 that extends between the first end portion 14 and the second end portion 16.

A pair of electrically conductive end cap means or assemblies 20 are each fixedly coupled to one of the housing end portions 14, 16. Viewing the lefthand side of FIG. 1, the end cap assembly 20 includes a generally cylindrical cap 22 and an insert 24 that is received within an outwardly extending, tubular portion of the cap 22. Both of the end cap assemblies 20 are essentially identical and have sealing means to preclude the conductance of fluid leakage into the chamber 18 from areas external of the fuse 10.

Figure 2:
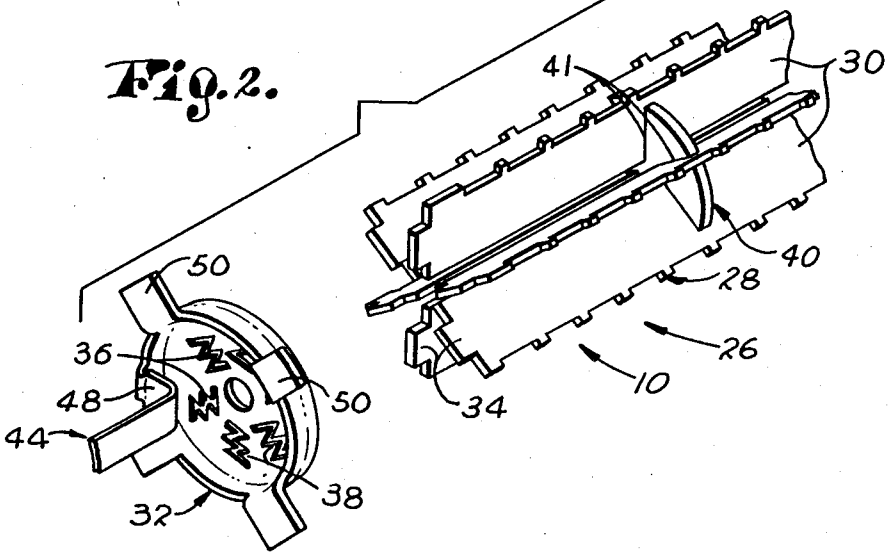
FIG. 2 is an exploded, perspective, fragmentary view of the support assembly shown in FIG. 1, particularly illustrating mica plates for supporting the fusible ribbons, a terminal bracket for engagement with an end section of each of the ribbon supporting plates, and one of three support discs that are disposed along the length of the plates for providing intermediate support for the assembly.
Figure 3:
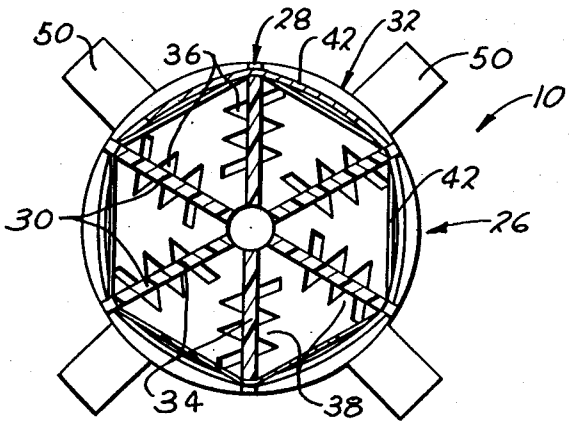
FIG. 3 is an enlarged cross-sectional view of the support assembly taken along line 3—3 of FIG. 1.

An elongated electrical subassembly 26, as illustrated in FIGS. 1-3, comprises an electrically insulative support 28 which takes the form of six flat, elongated, generally rectangular supports of plates 30 (see FIG. 2) that are formed of a flexible material preferably including mica or mica particles. The subassembly 26 has a pair of copper alloy terminal elements or brackets 32 each of which is fixed to one of two narrowed, rectangular end segments 34 (FIGS. 2 and 3) on the ends of each support plate 30 to support the plates 30 in radial fashion in spaced disposition to each other.

The terminal brackets 32 have structure defining six apertures 36 for receiving one of the end segments 34 of the support plates 30. The structure defining each of the apertures 36 presents a plurality of triangular projections 38 disposed in two spaced, opposed rows. During fabrication of the electrical subassembly 26, each of the projections 38 is bendable from a position spaced from the corresponding support plate end segment 34 to a position of clamping engagement with the same, for thereafter fixedly retaining the terminal bracket 32 in stationary disposition relative to the support plate 30.

The subassembly 26 also includes three disc shaped support bodies 40 that are disposed between the terminal brackets 32 in spaced relationship to each other. Each of the bodies 40 has walls defining a plurality of radially extending slots 41 (see FIG. 2) for receiving one of the six support plates 30. Each body 40 is preferably comprised of an electrically insulative, micaceous material.

Viewing FIGS. 1 and 3, two fusible elements or ribbons 42 are helically wound about the support 28 and are separated by notches 43 (see FIG. 1) formed in an outer edge portion of each support plate 30. Both ends of the fusible ribbons 42 are secured to the cylindrical surface on each of the terminal brackets 32 by means of a spot welding operation or the like.

Each of the terminal brackets 32 is integrally coupled to a flexible structure or leg 44 that mounts the electrical subassembly 26 longitudinally in the chamber 18 of housing 12. The legs 44 electrically and mechanically connect the terminal brackets 32 to one of the end cap assemblies 20 by means of a brazing operation such as is illustrated at 46 in FIG. 1.

Referring to FIGS. 1 and 2, each of the leg members or legs 44 includes a portion 48 that is swingable in an arc to permit variation in the distance of the terminal bracket 32 from the corresponding end cap assembly 20 while retaining the electrical connection between the terminal bracket 32 and the respective end cap assembly 20. The portion 48 of each of the legs 44 extends generally tranverse to the longitudinal axis of the subassembly 26 to enable movement of the terminal bracket 32 relative to the end cap assembly 20 with a minimum of mechanical stress. However, the portion 48 need not extend precisely in a perpendicular fashion relative to the longitudinal axis of the subassembly 26, since it is possible that the portion 48 could be at an inclination (of, for example, about 20°) from perpendicular and still function satisfactorily.

The brackets 32 also include four radially extending tabs 50 which are complementally received within the walls defining the housing chamber 18 to retain the subassembly 26 substantially in a position along the central axis of housing 12. In practice, good results have been obtained when the tabs 50 are of a length to remain spaced from the walls defining the chamber 18 at a distance of approximately 0.010 inch when the subassembly 26 is exactly centered from the walls defining the chamber 18. Although not shown, a quantity of silica sand is placed within the fuse 10 to completely fill chamber 18 and surround fusible elements 42 in order to provide an insulating means should a relatively large current melt and rupture the elements 42.

As can now be understood by those skilled in the art, the flexible legs 44 permit the housing to expand and contract during thermal cycling without mechanically separating the electrical connection between the end cap assemblies 20 and the associated terminal bracket 32. The thermal co-efficient of expansion of the housing 12 is different than the overall thermal co-efficient of expansion of the subassembly 26, and thus when the fuse 10 is exposed to thermal excursions, the distance between the end cap assemblies 20 can vary to a greater extent than the distance between the terminal brackets 32, and consequently during movement of the end cap assemblies 20 relative to each other the portions 48 of legs 44 swing in an arc to relieve stress on the legs 44, the terminal brackets 32, and the brazed joint 46. Such thermal excursions may occur, for example, when the fuse 10 is subject to thermal cycling tests prior to installation of the fuse 10, or subsequently when the fuse 10 is in service and exposed to fluctuations in environmental temperatures.

Moreover, the electrical subassembly 26 constitutes a rigid assembly through a unique arrangement of interlocking connections between the support plates 30, the terminal brackets 32 and the support bodies 40, even though the support plates 30 and the bodies 40 are of themselves flexible and somewhat weak in tensile strength. At the same time, the projections 38 on the brackets 32 substantially preclude the accidental separation of support plates 30 from the brackets 32. As such, the subassembly 26 represents a unit that can be readily manufactured and handled for subsequent installation within housing 12.

We claim:

1. A current limiting fuse comprising:

an elongated, electrically insulated housing having a first end portion, a second end portion remote from said first end portion, and walls defining an elongated chamber extending between said first end portion and said second end portion;

a pair of electrically conductive end cap means each fixedly coupled to one of said housing end portions;

an elongated electrical subassembly comprising at least one electrically insulative support having opposed end segments, a pair of terminal elements each presenting an outer periphery and respectively fixed to one of said end segments of said at least one support, and fusible element means carried by said at least one support and electrically connected to both of said terminal elements; and flexible structure mounting said electrical subassembly longitudinally in said chamber of said housing, said flexible structure being a pair of leg members each respectively electrically and mechanically connecting one of said terminal elements to one of said end cap means, each of said leg members including portions swingable in an arc to permit variation in the distance between the terminal elements and the corresponding end cap means while retaining an electrical connection between the terminal elements and the end cap means as the length of the housing is varied due to the effects of thermal expansion and contraction, each of said leg members being the only mechanical interconnection between the respective terminal element and the corresponding end cap means to enable movement of the terminal elements relative to the end cap means with a minimum of mechanical stress, each of said leg members including a swingable section extending radially inwardly from the peripheral edge of the respective terminal element, and a connection portion adjacent the end of said swingable section remote from said peripheral edge.

2. The invention of claim 1, wherein each of said leg members is generally L-shaped and integrally connected to each of said terminal elements.

3. The invention of claim 2, wherein said terminal elements each have structure defining an aperture for receiving an end portion of said at least one support, said aperture defining structure including projections bendable toward said end portion of said member for clampingly securing said terminal elements to said support.

4. A support assembly for a fusible element of a current limiting fuse comprising:

an elongated, electrically insulative support for engagement with a fusible element and presenting a first end segment and a second end segment remote from said first end segment; and a pair of electrically conductive terminal elements each having structure defining an aperture for receiving one of said end segments of said electrically insulative support, each of said aperture defining structures including at least one projection bendable from a position spaced from one of said support end segments to a position of clamping engagement with said one of said support end segments for retaining the terminal element in fixed disposition relative to said support.

5. The invention of claim 4, wherein said at least one projection presents a pointed tip for engagement with said one of said support end segments.

6. The invention of claim 5, wherein said electrically insulative support is comprised of a micaceous material.

7. The invention of claim 5, wherein said one of said support end segments is generally flat and presents two sides, and there being a plurality of said projections disposed in two spaced, opposed rows for engagement with both sides of said one of said support end segments.

8. The invention of claim 4, there being a plurality of said electrically insulative supports each having a flat, plate-like configuration, said supports being arranged in spaced, radially oriented fashion around the center of each of said terminal elements.

9. The invention of claim 8; including at least one support body disposed between said terminal elements and having walls defining a plurality of slots each receiving one of said insulative supports.

* * * * *